US006427369B1

(12) United States Patent
Durinzi, Jr. et al.

(10) Patent No.: US 6,427,369 B1
(45) Date of Patent: Aug. 6, 2002

(54) ADVERTISING KIOSK

(75) Inventors: Dominic J. Durinzi, Jr., Mt. Laurel, NJ (US); Robert Goepel, North Hills; Jozef Rzeznik, Conshohocken, both of PA (US)

(73) Assignee: Silver Cat, LLC, Cherry Hill, NJ (US)

( * ) Notice: Subject to any disclaimer, the term of this patent is extended or adjusted under 35 U.S.C. 154(b) by 0 days.

(21) Appl. No.: 09/537,928

(22) Filed: Mar. 29, 2000

(51) Int. Cl.[7] ..... G09F 13/04
(52) U.S. Cl. ..... 40/564; 362/812
(58) Field of Search ..... 40/564, 660, 575, 40/572; 362/812

(56) References Cited

U.S. PATENT DOCUMENTS

| | | | | | |
|---|---|---|---|---|---|
| 3,713,237 | A | * | 1/1973 | Thomson et al. | 40/132 D |
| 3,947,985 | A | * | 4/1976 | Skrzypczak | 40/33 |
| 4,118,082 | A | * | 10/1978 | Hoop | 312/59 |
| 4,263,737 | A | * | 4/1981 | Simon | 40/453 |
| 4,453,327 | A | | 6/1984 | Clarke | 40/562 |
| D274,629 | S | | 7/1984 | Plumettaz | D20/10 |
| 4,608,773 | A | * | 9/1986 | White | 40/606 |
| D289,062 | S | | 3/1987 | Paulmier | D20/10 |
| D296,221 | S | | 6/1988 | Kissler | D20/10 |
| 4,754,582 | A | * | 7/1988 | Cameron | 52/27 |
| 4,827,645 | A | * | 5/1989 | Stamps, Jr. | 40/567 |
| 4,959,763 | A | * | 9/1990 | Baggott | 40/605 |
| 4,961,294 | A | * | 10/1990 | Cameron | 52/27 |
| D314,014 | S | | 1/1991 | Decaux | D20/10 |
| 5,031,366 | A | * | 7/1991 | Cameron | 52/27 |
| D330,392 | S | | 10/1992 | Vazeille et al. | D20/10 |
| D331,077 | S | | 11/1992 | Foster | D20/10 |
| 5,248,536 | A | * | 9/1993 | Du Katz | 428/40 |
| D357,943 | S | | 5/1995 | Szekely | D20/10 |
| D362,024 | S | | 9/1995 | Summa | D20/10 |
| 5,465,515 | A | * | 11/1995 | Walieddine | 40/471 |
| 5,485,693 | A | * | 1/1996 | Frenken et al. | 40/505 |
| 5,542,554 | A | * | 8/1996 | Resnick | 211/186 |
| D377,197 | S | | 1/1997 | McKoy, Sr. | D20/10 |
| 5,663,746 | A | * | 9/1997 | Pellenberg et al. | 345/113 |
| 5,724,775 | A | * | 3/1998 | Zobel, Jr. et al. | 52/82 |
| 5,947,584 | A | * | 9/1999 | Passanante et al. | 362/154 |
| 5,967,355 | A | * | 10/1999 | Ragot | 220/4.32 |
| 6,012,790 | A | * | 1/2000 | Thomas et al. | 312/257.1 |
| 6,076,694 | A | * | 6/2000 | Ragot | 220/23.83 |
| 6,148,552 | A | * | 11/2000 | Dumontier et al. | 40/473 |
| 6,215,411 | B1 | * | 4/2001 | Gothard | 340/815.4 |

* cited by examiner

*Primary Examiner*—Matthew C. Graham
*Assistant Examiner*—Devon Kramer
(74) *Attorney, Agent, or Firm*—Caesar, Rivise, Bernstein, Cohen & Pokotilow, Ltd.

(57) ABSTRACT

An advertising kiosk for holding a pair of translucent sheets of advertising copy. The kiosk is particularly suited for outdoor use and has a totally enclosed housing with pair of windows in which the sheets of the advertising copy are located. Plural fluorescent lamps are mounted at equidistantly spaced locations adjacent the windows and behind each sheet of advertising copy on a movable frame. Each window of the kiosk is covered by a transparent outer panel having an inner surface behind which the advertising copy is mounted. The advertising copy is held in place by a flexible diffuser sheet hingedly connected to the housing. Each diffuser sheet is adapted to flex into engagement with the advertising copy, whereupon the advertising copy is held tightly and evenly against the inner surface of the outer panel. The lamps provide even light through the diffuser sheet, the advertising copy and the outer panel, to illuminate the advertising copy for visibility by persons outside of the kiosk. The housing is in the form of a support shell which is covered by a smooth stainless steel skin secured to the shell via plural studs capacitively-discharge welded thereto. The studs extend through aligned apertures in the shell. Plural air vents are provided at the bottom of the housing and an air outlet is provided at the top of the housing to enable air to freely flow through the kiosk.

44 Claims, 13 Drawing Sheets

FIG. 6
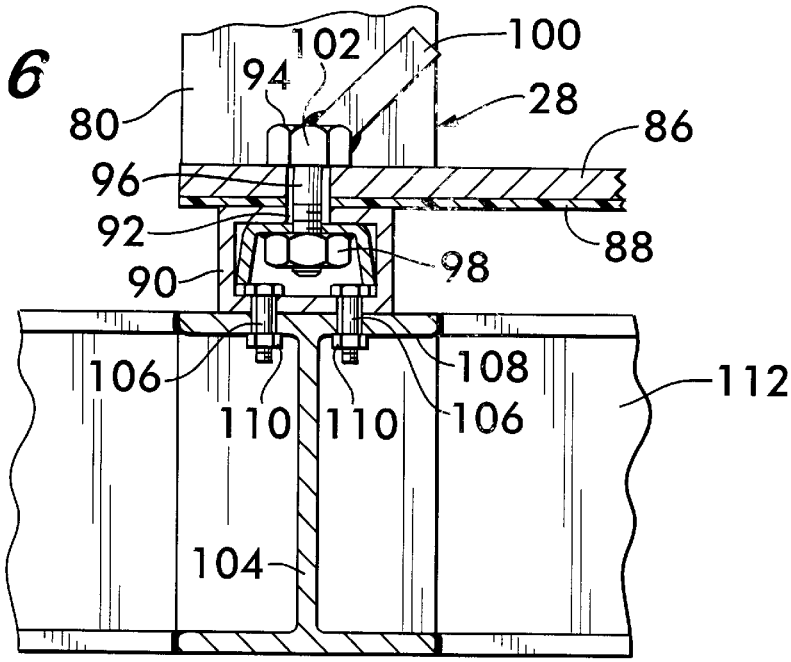
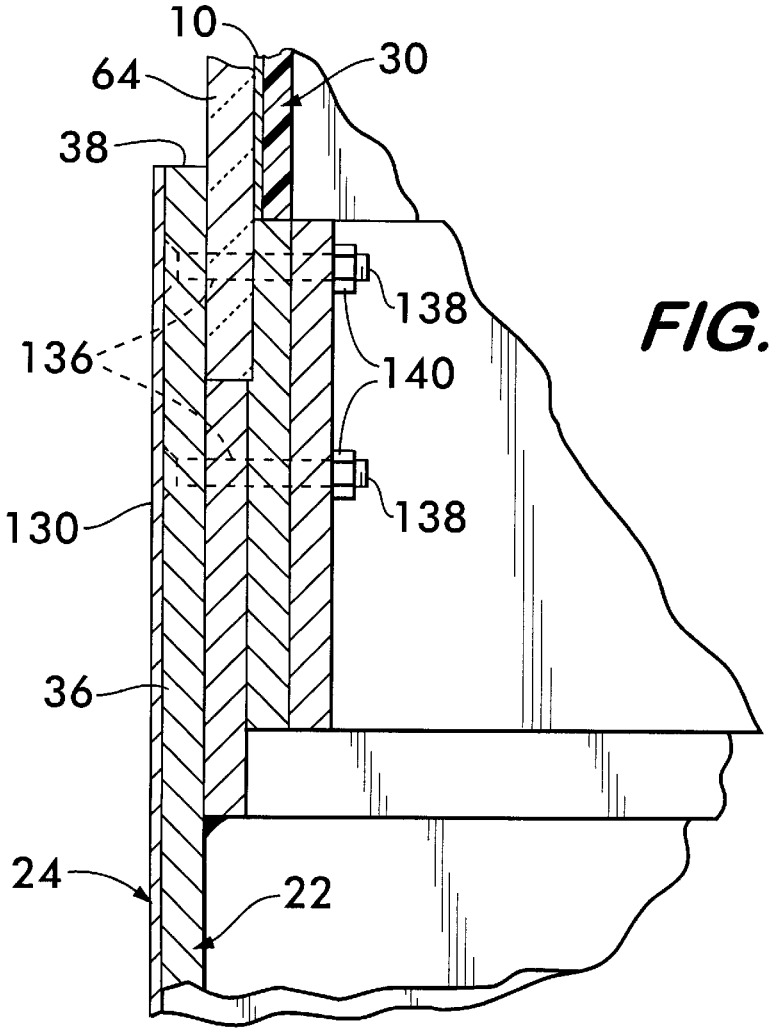
FIG. 7

FIG.9
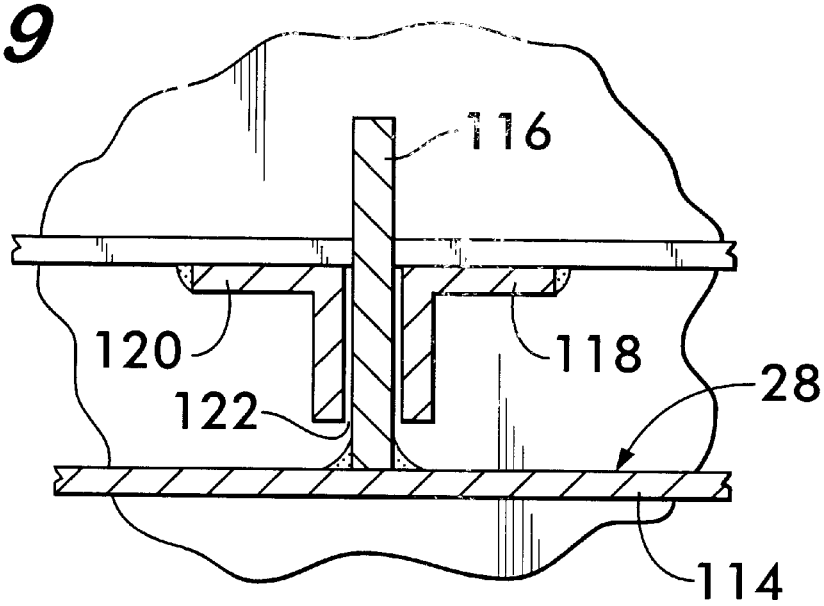
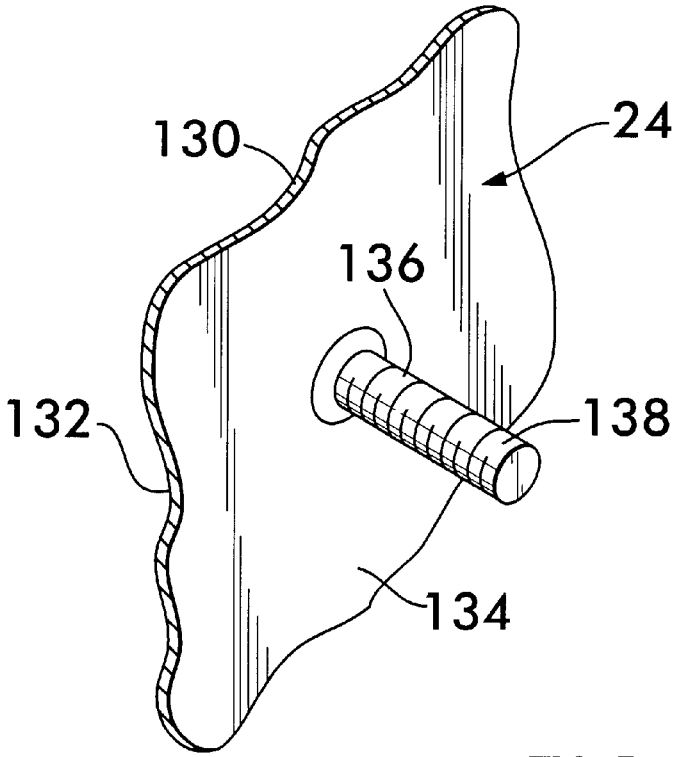
FIG.10

ADVERTISING KIOSK

FIELD OF THE INVENTION

This invention relates generally to display apparatus and more particularly to kiosks for displaying sheets bearing advertising copy.

BACKGROUND OF THE INVENTION

One common type of advertising display apparatus is the "kiosk." A kiosk basically comprises a self supporting structure, such as a frame, pedestal or hollow housing arranged to be mounted on some surface, e.g., the floor. The support structure serves to hold a panel in which or on which one or more sheets of advertising copy, e.g., a photograph or other graphics and/or text, may be mounted for viewing by persons passing by the kiosk.

In U.S. Letters Pat. No. 4,608,773 (White) there is disclosed a kiosk display unit in the form of a pedestal consisting of plural, e.g., three, identical sheet metal panels which are secured together, to form a structure closed upon itself, by interengaging hook tabs and tab-receiving openings in flanges along edges of the panels. The kiosk is not illuminated and is particularly suitable for indoor applications where it can be readily assembled and disassembled.

In U.S. Letters Pat. No. 4,959,763 (Baggott) there is disclosed a display frame which can be assembled to form a kiosk display unit. The kiosk includes posts having lengthwise slots into which the edges of sheets of advertising material can be placed to support the advertising material sheets on panels for viewing. A light fixture may be included on the kiosk to illuminate the advertising materials from above. The display unit of this patent, like the White patent appears particularly suitable for indoor applications.

In U.S. Letters Pat. No. 4,453,327 (Clarke) there is disclosed an advertising display kiosk which is particularly suitable for outdoor applications. That kiosk includes an upright cylindrical housing having an open upper end. A roof is mounted on the top of the cylinder. Plural, e.g., 12, display panels are mounted about the periphery of the cylinder under the roof. Each display panel is arranged to support a respective advertising poster. The posters are transparent or translucent. The open upper end of the cylinder is covered by a transparent dome to enable sunlight to enter into the cylinder to be reflected outward through the posters to illuminate them.

Various ornamental designs for advertising kiosks exist in the following U.S. Design Pat. No. : D274,629 (Plumettaz); U.S. Pat. No. D296,221 (Kissler); U.S. Pat. No. 0,289,062 (Paulmier); U.S. Pat No. D314,014 (Decaux); U.S. Pat. No. D330,392 (Vazeille et al.); U.S. Pat. No. D331,077 (Foster); U.S. Pat. No. D357,943 (Szekely); U.S. Pat. No. D362,024 (Summa); and U.S. Pat. No. D377,197 (McKoy, Sr.).

The prior art advertising kiosks leave much to be desired from various standpoints, such as ability to protect the advertising copy from the elements, ability to enable the ready changing of the advertising copy, even illumination of the advertising copy, ready visibility of the advertising copy, convenience of servicing the kiosk, and general aesthetics, e.g., the kiosk providing a clean, uncluttered, unblemished and non-distracting appearance for the advertising copy held thereby.

OBJECTS OF THE INVENTION

Accordingly, it is a general object of this invention to provide an advertising kiosk which addresses the needs of the prior art.

It is another object of this invention to provide a kiosk which is particularly suitable for location outdoors to display advertising copy while protecting it from the elements.

It is another object of this invention to provide a rugged, fully enclosed internally illuminated kiosk.

It is another object of this invention to provide a kiosk which holds sheets of advertising copy in a manner to enable the copy to be replaced easily and quickly from within the kiosk by a worker.

It is another object of this invention to provide a kiosk which holds sheets of advertising copy to illuminate them from the interior of the kiosk, so that light passes evenly through it, thereby creating an aesthetically pleasing appearance.

It is another object of this invention to provide a kiosk which holds sheets of advertising copy illuminated from the interior of the kiosk by lamps therein, and which lamps are mounted in a manner so that they can be readily serviced by a worker within the kiosk.

It is another object of this invention to provide an internally illuminated kiosk having a convection air-flow system through the kiosk so that there is no fogging of the advertising copy by moisture intrusion.

It is another object of this invention to provide an advertising kiosk whose exterior surface is smooth and uncluttered.

It is yet another object of this invention to provide an advertising kiosk having a stainless steel outer surface to render it weather resistant, yet which surface is smooth, unblemished and uncluttered, thereby resulting in an aesthetically pleasing appearance.

It is yet another object of this invention to provide an advertising kiosk having a stainless steel outer surface which can be readily attached to the kiosk without any exteriorly visible attachment devices, such as bolts, nuts, etc.

SUMMARY OF THE INVENTION

In accordance with one aspect of this invention a kiosk is provided for supporting at least one sheet of advertising copy, the sheet of advertising copy being formed of a translucent material and bearing graphics and/or text thereon, e.g., a photograph of a professional athlete with or without text. The kiosk is arranged to be mounted on any suitable horizontal support surface, e.g, the pavement outdoors, and comprises a hollow shell having at least one window located therein, a source of illumination located within the shell and adjacent the window, and a flexible light diffuser sheet. The window is covered by a transparent, e.g,. LEXAN®, outer panel secured to the shell. The outer panel has an inner surface behind which the sheet of advertising copy is arranged to be mounted.

The flexible diffuser sheet is hingedly connected to the shell and is disposed at the window behind the outer panel. The diffuser is adapted to flex into engagement with the sheet of advertising copy, whereupon the sheet of advertising copy is held tightly and evenly against the inner surface of the outer panel by the diffuser.

The source of illumination provides light through the diffuser, the advertising copy sheet and the outer panel, to illuminate the advertising copy for visibility by persons outside of the kiosk. In accordance with one exemplary embodiment, the diffuser is a white translucent sheet to diffuse the light passing through it, to evenly illuminate the advertising copy, whereupon the advertising copy appears to glow.

In accordance with another aspect of this invention a kiosk is provided for supporting at least one sheet of advertising copy. The sheet of advertising copy is formed of a translucent material and bears graphics and/or text thereon. The kiosk is arranged to be mounted on a support surface, e.g., the pavement outdoors, and comprises a hollow shell having at least one window located therein, a source of illumination located within the shell and adjacent the window. The window is covered by a transparent outer panel secured to the shell. The outer panel has an inner surface behind which the sheet of advertising copy is arranged to be disposed The source of illumination comprises plural elongated lamps, e.g., high intensity fluorescent lamps, mounted on a support frame within the shell so that they are disposed vertically at equidistantly spaced locations behind the window and on a substantially concentric radius therewith to effect the even illumination of the advertising copy sheet for visibility by persons outside of the kiosk.

In accordance with still another aspect of this invention a kiosk is provided for supporting at least one sheet of advertising copy. The sheet of advertising copy is formed of a translucent material and bears graphics and/or text thereon. The kiosk is arranged to be mounted on a support surface, e.g., the pavement outdoors, and comprises a sealed housing including a hollow shell adapted to have a worker enter the shell (e.g., via a door) for maintenance of the kiosk, whereupon the worker is protected from the ambient conditions outside of the kiosk.

The kiosk also includes a window in the shell and source of illumination located within the shell adjacent the window. The window is covered by a transparent outer panel secured to the shell. The outer panel has an inner surface behind which the sheet of advertising copy is arranged to be disposed. The source of illumination is arranged to effect the illumination of the advertising copy sheet for visibility by persons outside of the kiosk.

The shell includes a bottom portion, a top portion, at least one air-intake opening (preferably several spaced air-intake openings) in the bottom portion of the shell, and an air-outlet in the top portion of the shell to facilitate the flow of air through the shell.

In accordance with yet another aspect of this invention a kiosk is provided for supporting at least one sheet of advertising copy. The sheet of advertising copy is formed of a translucent material and bears graphics and/or text thereon. The kiosk is arranged to be mounted on a support surface, e.g., the pavement outdoors, and comprises a sealed housing including a hollow shell adapted to have a worker enter the shell for maintenance of the kiosk, whereupon the worker is protected from the ambient conditions outside of the kiosk, an outer covering or skin for the shell, and a source of illumination located within the shell adjacent the window. The shell also includes plural apertures therein.

The outer covering or skin comprises at least one flexible panel having an outer surface, an inner surface and plural first connector elements, e.g., threaded studs which are electro-capacitive welded, to the inner surface of the panel. This type of bonding ensures that there is no trace of blemish on the outer surface where each stud is located so that the skin is clean, unblemished and uncluttered. Each flexible skin panel is mounted on the shell by extending its plural connector elements through the apertures in the portion of the shell to be covered, e.g., so that threaded nuts may be secured to the threaded studs and in engagement with the inner surface of the shell.

In accordance with yet another aspect of this invention a kiosk is provided for supporting at least one sheet of advertising copy. The sheet of advertising copy is formed of a translucent material and bears graphics and/or text thereon. The kiosk is arranged to be mounted on a support surface, e.g., the pavement outdoors, and comprises a hollow shell having at least one window located therein, a source of illumination located within the shell and adjacent the window and a support frame mounting the source of illumination within the shell. The window is covered by a transparent outer panel secured to the shell and has an inner surface behind which the sheet of advertising copy is arranged to be disposed. The support frame, e.g., a ladder-like member having plural rungs, is movably mounted within the shell to enable a worker to move the support frame to a position within the shell to give the worker sufficient room to work within the kiosk, e.g., to service any components from within, protected from the outdoor weather. The source of illumination, e.g., high intensity fluorescent lamps, are mounted on the support frame to effect the even illumination of the advertising copy sheet for visibility by persons outside of the kiosk.

DESCRIPTION OF THE DRAWING

FIG. 6 is an enlarged sectional view taken along line 6—6 of FIG. 4B;

FIG. 7 is an enlarged sectional view taken along line 7—7 of FIG. 1;

FIG. 9 is an enlarged sectional view taken along line 9—9 of FIG. 4A; and FIG. 10 is an enlarged isometric view of a portion of the skin sub-system of the Kiosk of this invention.

DETAILED DESCRIPTION OF THE PREFERRED EMBODIMENT

Figure 1:
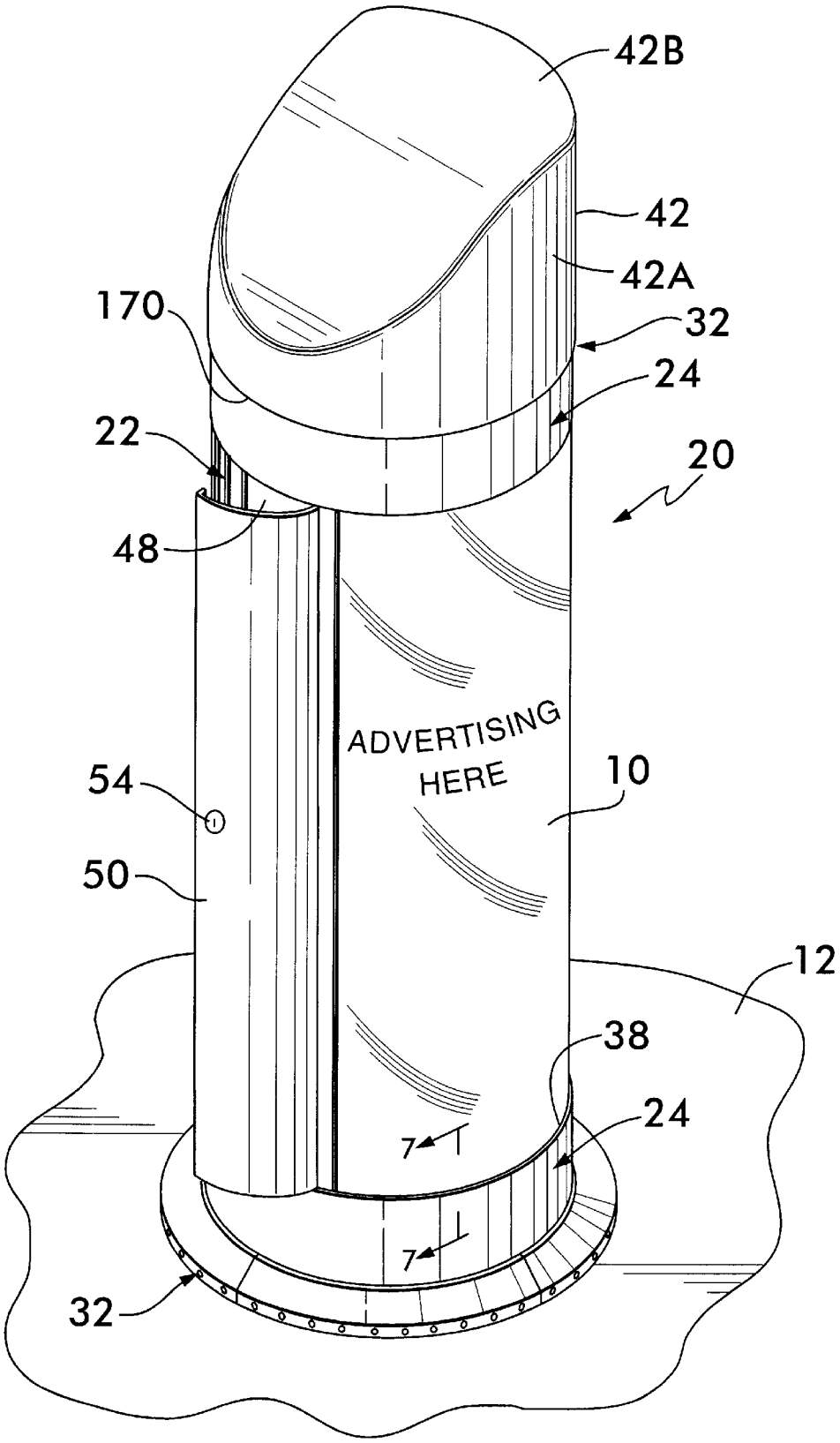
Fig.1 is an isometric view of one embodiment of an advertising kiosk system constructed in accordance with this invention and shown with a entrance door being open to provide access into the interior of the kiosk.

Referring now to the various figures of the drawing wherein like reference characters refer to like parts, there is shown in FIG. 1 an advertising kiosk 20 constructed in accordance with this invention. The kiosk 20 is arranged to support two sheets 10 of advertising copy (although the kiosk can be modified to include only one or more than two sheets—as will be discussed later). The kiosk 20 is arranged to be permanently mounted at any location for easy visibility by persons passing by, and is particularly suitable for outdoor applications since it is wind and weather resistant. Each sheet of the advertising copy is preferably translucent or transparent, since the kiosk is arranged to illuminate the advertising copy sheet from the interior of the kiosk, whereupon light passes outward through the sheet.

The particular type of advertising copy utilized is a matter of choice and may be graphics in the form of photographs, drawings, etc., with or without text. For example, if the kiosk is located outside a sports arena the advertising copy may be in the form of a photograph of a professional athlete who appears at that arena. Moreover, the material making up the advertising copy sheet can be Mylar, other polymers, paper or any other material through which light may pass.

The kiosk 20 of this invention basically comprises six sub-systems or assemblies of components, each of which will be described in detail later. Suffice it for now to state that those sub-systems are: a hollow support structure or shell forming the housing 22 (FIGS. 1–4) of the kiosk 20, a skin sub-system 24 (FIGS. 1–4 and 10) arranged to be mounted on the exterior of the shell 22 to provide a smooth, uncluttered, unblemished and damage resistant exterior surface, an illumination sub-system 26 (FIGS. 2–4) for illuminating of the advertising copy from within the housing 22, a movable illumination support frame sub-system 28 (FIGS. 2–4, 5A, 5B, and 7–9) for movably supporting the illumination support system 26 providing ready access to the components within the interior of the kiosk 20, an advertising copy holding sub-system 30 (FIGS. 5C, 5D, and 7) for facilitating the mounting and changing of the sheets of advertising copy 10, and a ventilation or air-flow sub-system 32 (FIGS. 1–4) for enabling air to freely flow through the housing to prevent fogging of the advertising copy while also serving to protect the internal components and advertising copy from heat and/or moisture induced damage.

Before describing the details of the sub-systems making up the kiosk 20, it should be noted that the shape and/or size of any kiosk constructed in accordance with this invention is a matter of choice based on design and aesthetics. In particular, the kiosk 20 can be of other shapes and/or sizes than that shown in FIG. 1 and described hereinafter. Thus, it must be appreciated that the embodiment of the kiosk shown herein is merely one exemplary embodiment of the invention. Moreover, the kiosk 20 can be constructed to include one or more of the sub-systems 22–32, depending upon the application for the kiosk. For example, for some applications the kiosk may not include any internal lighting sub-system 26, e.g., if the application for the kiosk is to make use of reflected light to illuminate the advertising copy from outside the kiosk.

Referring now to FIG. 1 it can be seen that the kiosk 20 is in the form of a upright structure arranged to be mounted on any horizontal surface, such as a wooden platform, on the pavement 12 outside an arena, on a city street, etc.

Figure 2:
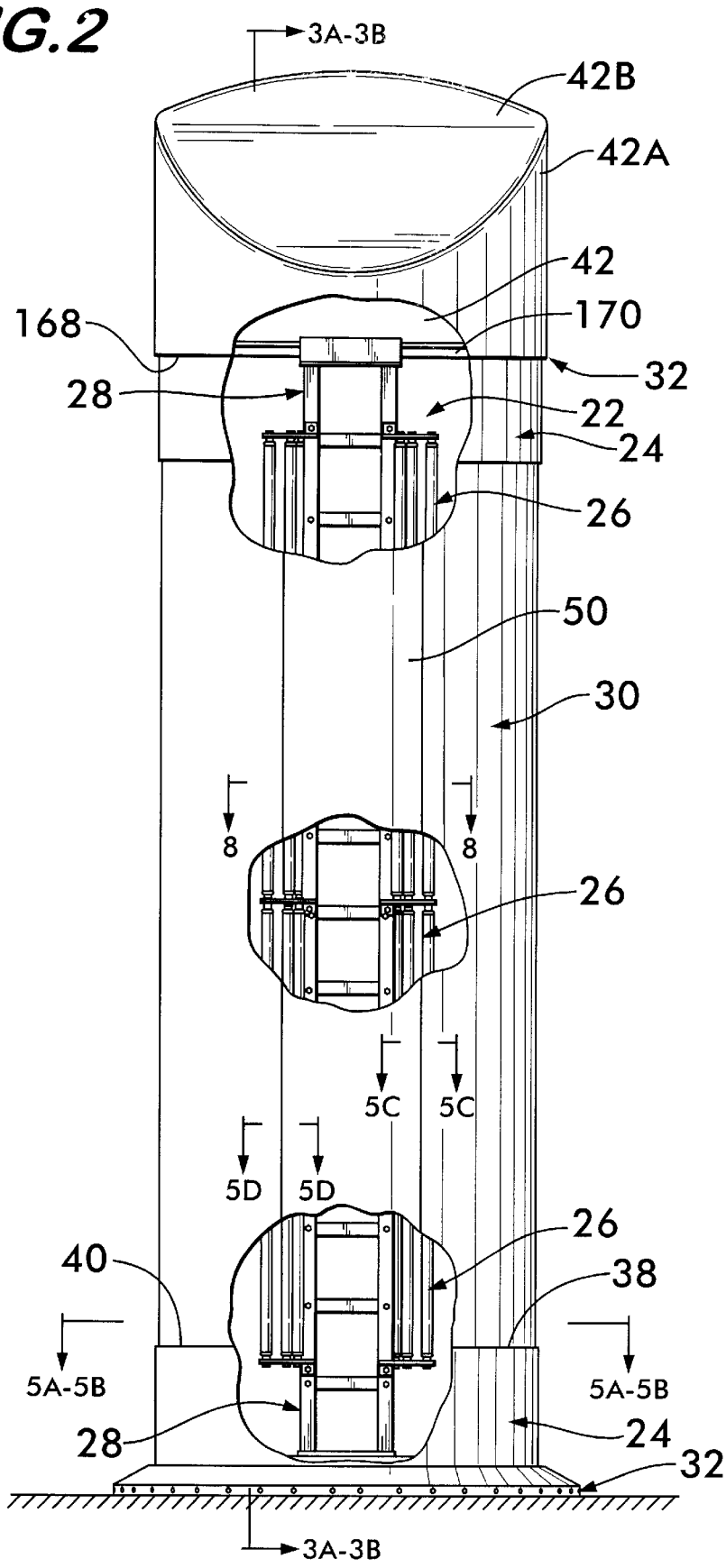
FIG. 2 is a front elevational view of the kiosk shown in FIG. 1, partially broken away to show its internal illumination sub-system and its illumination support subsystem.
Figure 3A:
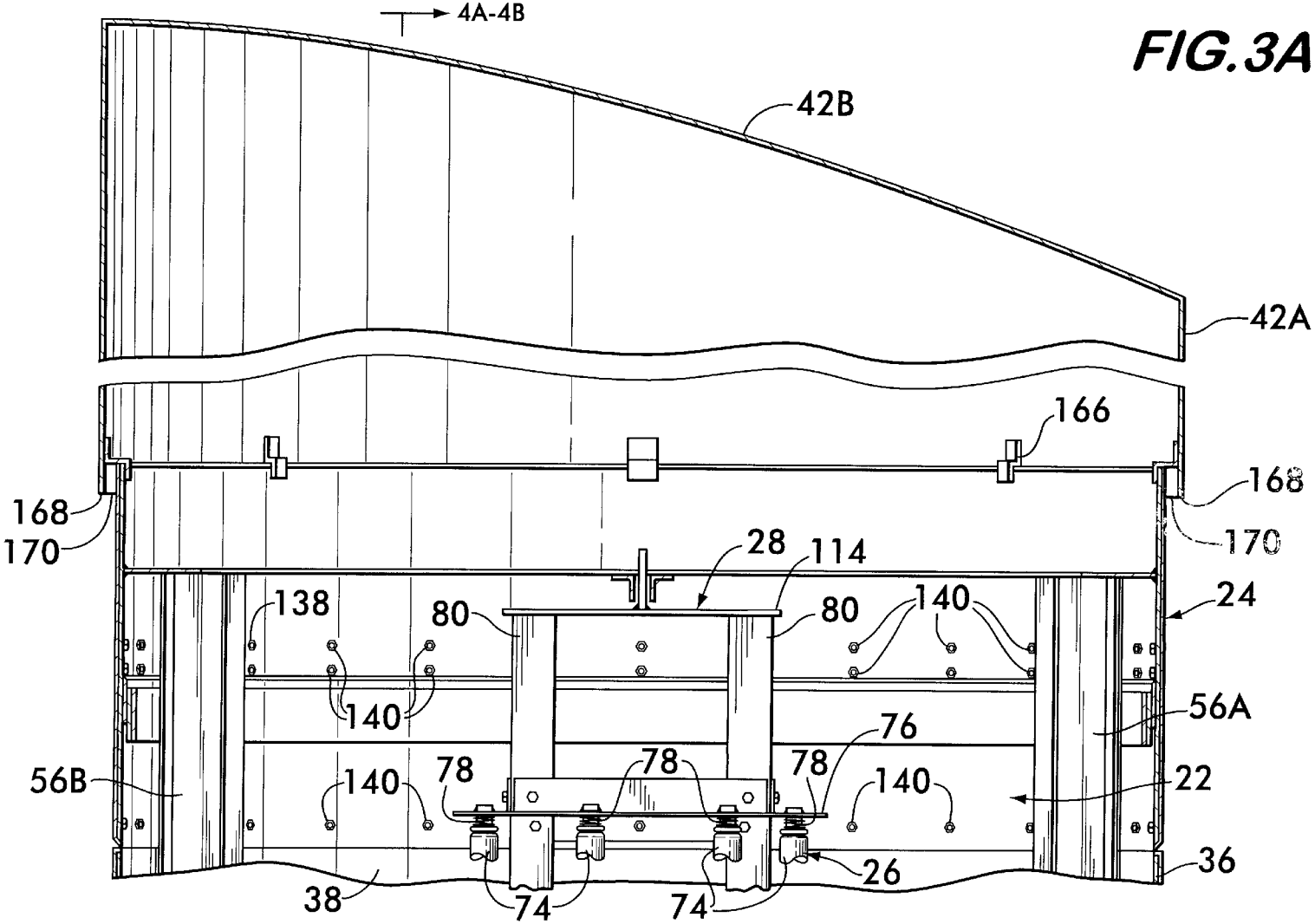
FIG. 3A is an enlarged sectional view of the top portion of the kiosk taken along line 3A–3B of FIG. 2.
Figure 3B:
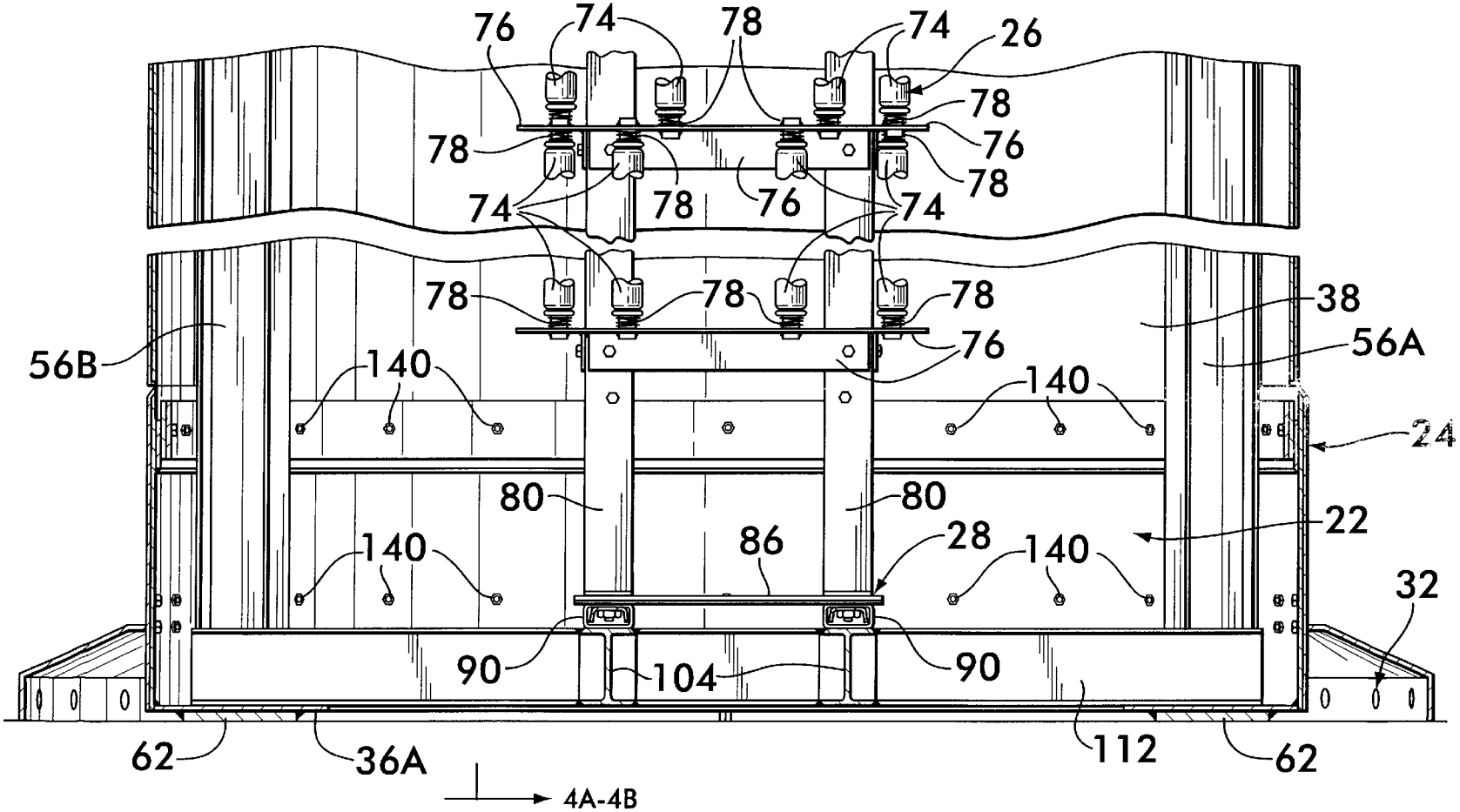
FIG. 3B is an enlarged sectional view of the bottom portion of the kiosk taken along line 3A–3B of FIG. 2.
Figure 4A:
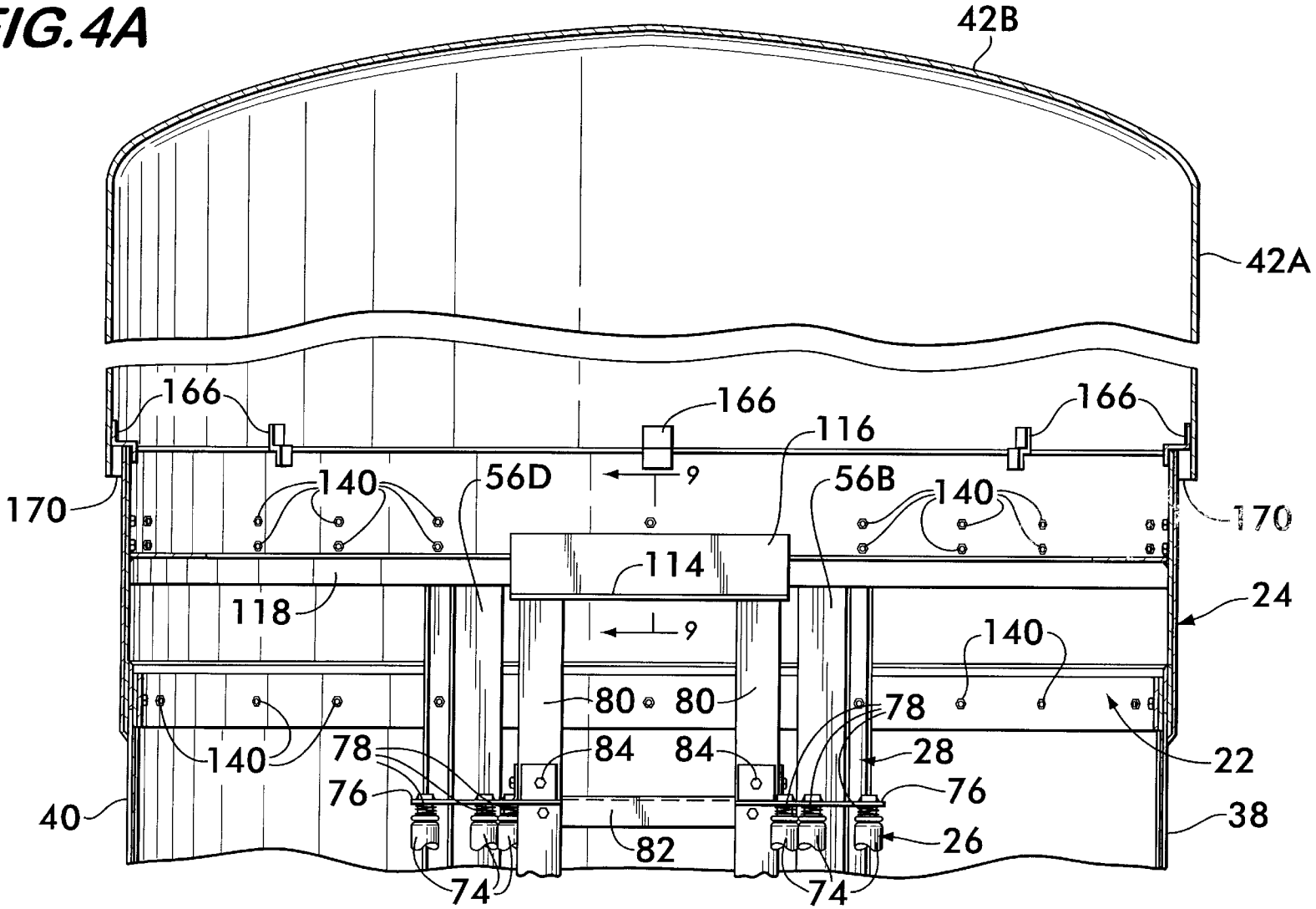
FIG. 4A is a sectional view of the top portion of the kiosk taken along line 4A–4B of FIGS. 3A and 3B.
Figure 4B:
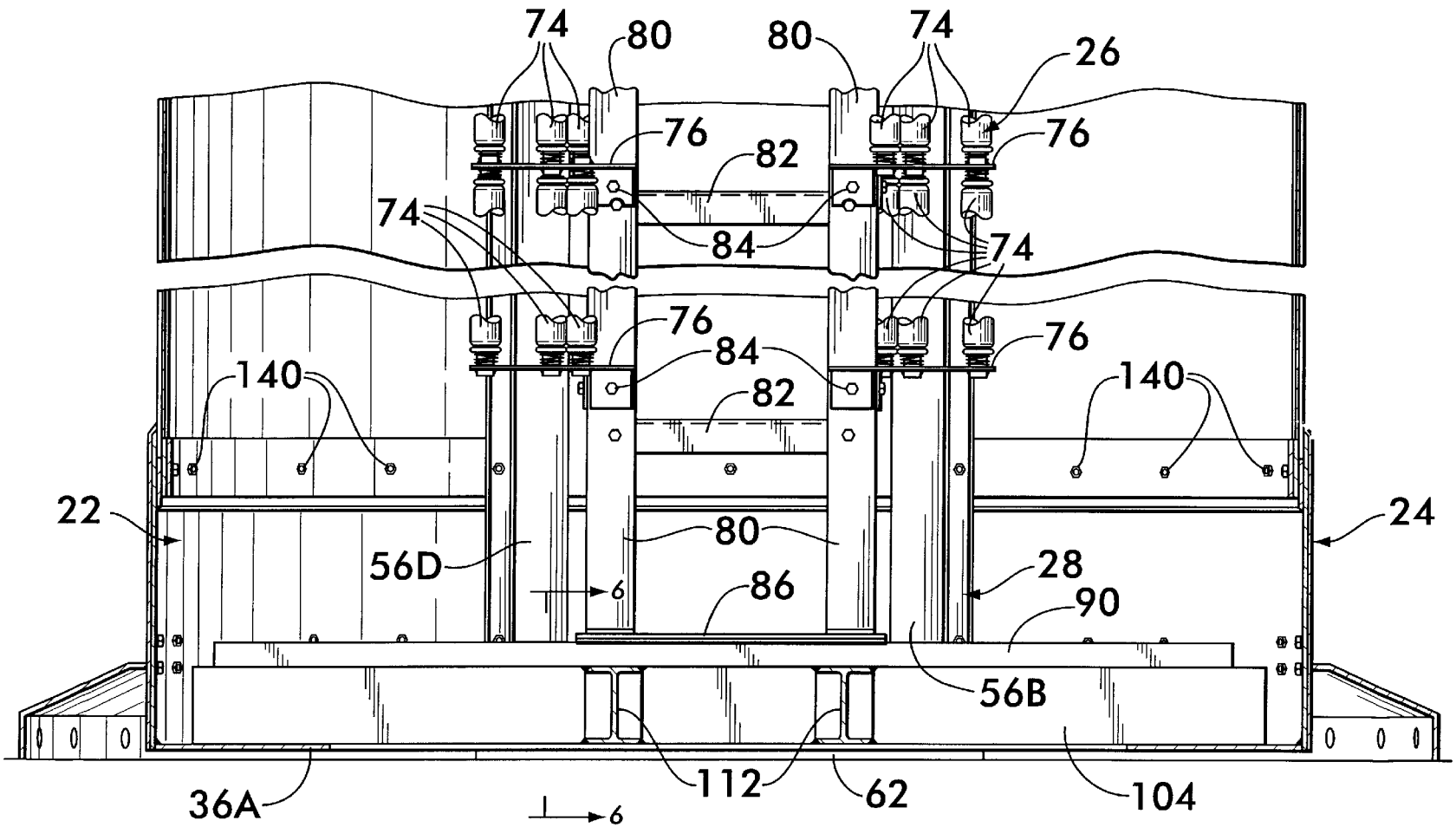
FIG. 4B is a sectional view of the bottom portion of the kiosk taken along line 4A–4B of FIGS. 3A and 3B.

It should be noted at this juncture, that while the kiosk 20 is particularly suited for outdoor applications, it can be used indoors, e.g., within an arena, as well. The housing sub-system 22 for the kiosk is in the form of a hollow cylindrical support shell 36 formed of any strong material, light-weight, corrosion resistant material, e.g., aircraft-grade aluminum. The bottom of the shell 36 is in the form of a planar disk or base 36A which is welded to the lower edge of the cylindrical shell as shown in FIGS. 3B and 4B to form an inwardly flanged base for the shell. As mentioned earlier and as will be described in detail later the shell is covered by the skin sub-system 30, e.g., a stainless steel skin. The skin provides a tough, smooth, unblemished and uncluttered appearance, thereby enhancing the aesthetics of the advertising copy by not diverting the viewer's attention from the copy. The cylindrical portion of the shell 36 includes a pair of rectangular shaped openings or windows 38 and 40 (FIGS. 1 and 2). These windows serve to hold the two respective sheets of advertising copy 10 therein and are disposed diametrically opposed from each other in the shell. A respective clear, scratch-resistant arcuate outer panel (to be described later) is mounted in each window to close it off. The sheet of advertising copy 10 that is located in the window is held against the inner surface of the window's outer panel by the heretofore identified advertising copy holding sub-system 30.

As best seen in FIGS. 1, 2, 5A and 5B each window 38 and 40 extends for a substantial portion, e.g., 140–160 degrees, of an arc of the circumference of the shell 36. Moreover each window extends vertically for the major length of the shell. In the exemplary embodiment shown the shell of the kiosk is approximately 18.25 feet (5.56 meters) high and of a diameter of 60.5 inches (1.54 meters), with each window being approximately 11.42 feet (3.48 meters) high and 5.58 feet (1.7 meters) wide. The top of the shell is closed off by a cap or header member 42. The cap is in the form of a cylindrical sidewall 44 and a curved truncated top wall 46. The sidewall of the same diameter as that of the shell. The header is mounted on the top edge of the shell 36 by means of plural brackets (to be discussed later) to form an air-vent (also to be described later and which makes up a portion of the ventilation or air-flow sub-system 32) between it and the shell. The header 42 can be formed of any suitable material. In the preferred embodiment shown the header is formed of fiberglass.

The header 42 can be of any shape, depending upon aesthetics or other reasons. Thus, the particular shape of the header shown herein, i.e., the top of the header having a cylindrical side wall 42A and a truncated curved top wall 42B is merely exemplary of a myriad of shapes the header can assume. In the embodiment shown the header is approximately 43.25 inches (1.1 meters) high.

In order to provide access to the interior of the kiosk for servicing of its interior components, a doorway 48 is located in the shell 36 between adjacent edges of the two windows (as shown in FIG. 1). An arcuate door 50 is mounted by a hinge 52 (FIGS. 5B–5D) within the doorway 48. A pair of lock 54 (only one of which can be seen in FIGS. 1 and 5D) is provided in the door to prevent unauthorized access into the interior of the kiosk. The locks are located one adjacent the top of the door and the other adjacent the bottom of the door. The door 50 is formed of the same material as the skin subsystem 30, namely, stainless steel. Thus, the entire exterior surface of the kiosk, except for the header 42 and a conical skirt (to be described later and forming a portion of the ventilation sub-system 32) is in the form of a smooth unblemished protective surface, e.g., stainless steel.

Figure 5A:
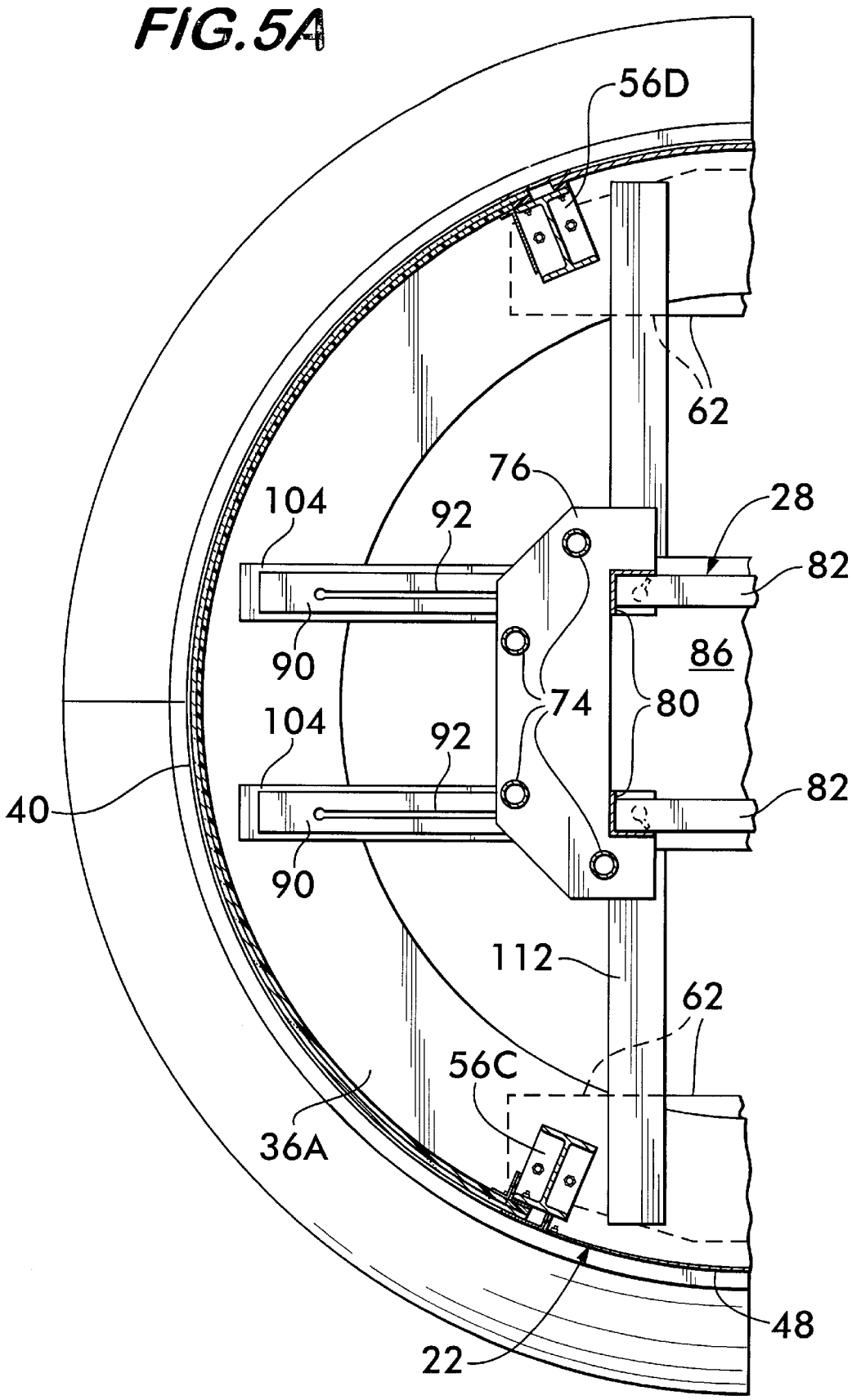
FIG. 5A is an enlarged sectional view of one side portion of the kiosk taken along line 5A–5B of FIG. 2.
Figure 5B:
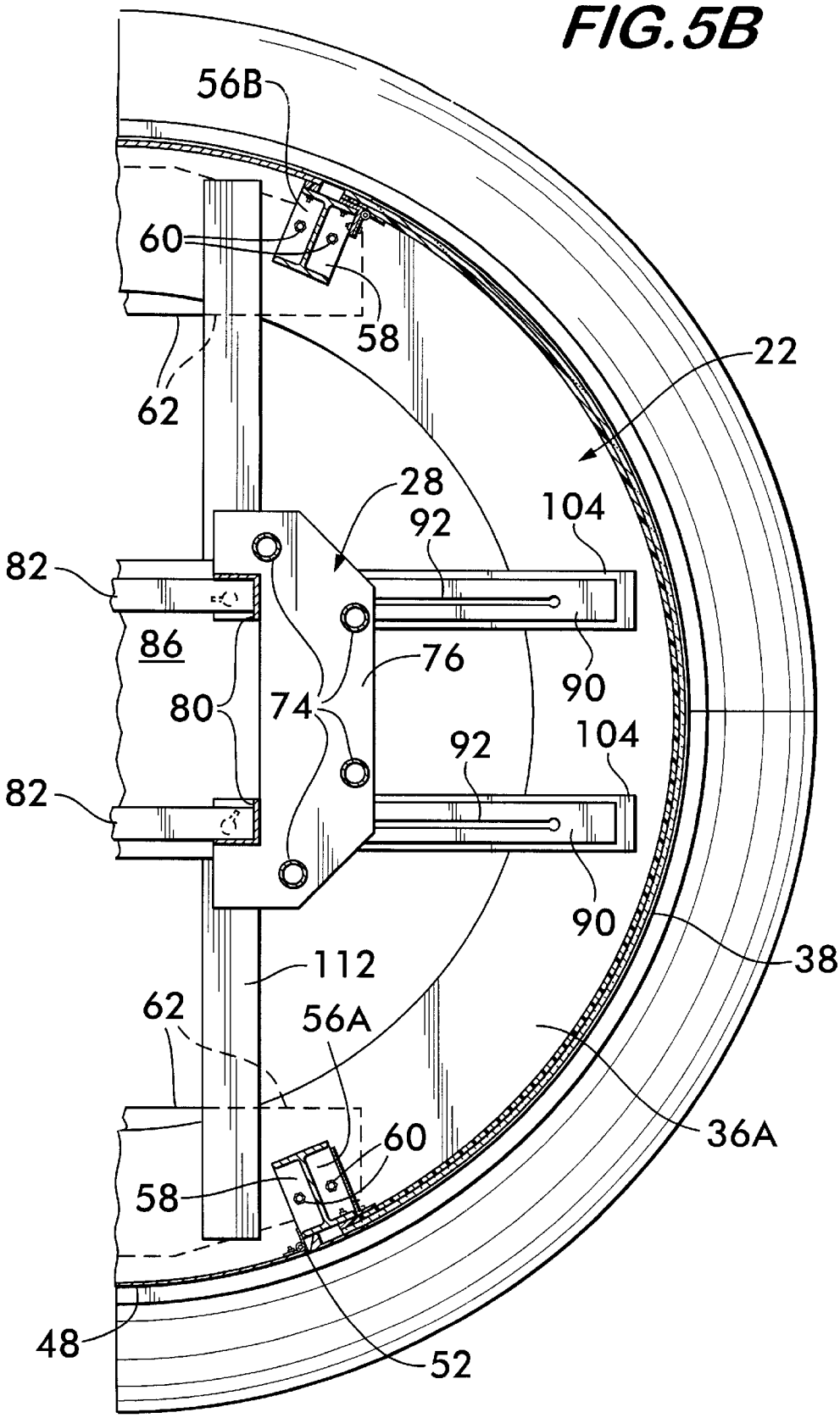
FIG. 5B is an enlarged sectional view of the opposite side portion of the kiosk taken along line 5A–5B of FIG. 2.

Four I-beams 56A–56D are mounted within the interior of the shell 36 at spaced locations to provide further structural support for the shell. The I-beams are formed of any suitable material, e.g., corrosion resistant aluminum, and are oriented vertically. One I-beam 56A is located along one side of the window 38, while the I-beam 56B is located along the other side of that window as best seen in FIGS. 5B. The I-beam 56C is located along one side of the window 40, while the I-beam 56D is located along the other side of that window as best seen in FIGS. 5A. The bottom end of each I-beam includes a plate 58 welded thereto. As best seen in FIGS. 5A–D all of the I-beams 56A and 56C are bolted, via respective pairs of bolts 60 extending through their respective plates 58, to the annular base 36A of the shell 36. A pair of mounting plates 62 (FIGS. 3B, 5A and 5B) are welded under the base 36A and are also secured on the surface, e.g., pavement, 12 on which the kiosk 20 is to be mounted. Each of the mounting plates 62 is of a somewhat trapezoidal shape and is secured to the surface 12 via any suitable means, e.g., epoxied bolts (not shown).

Figure 5C:
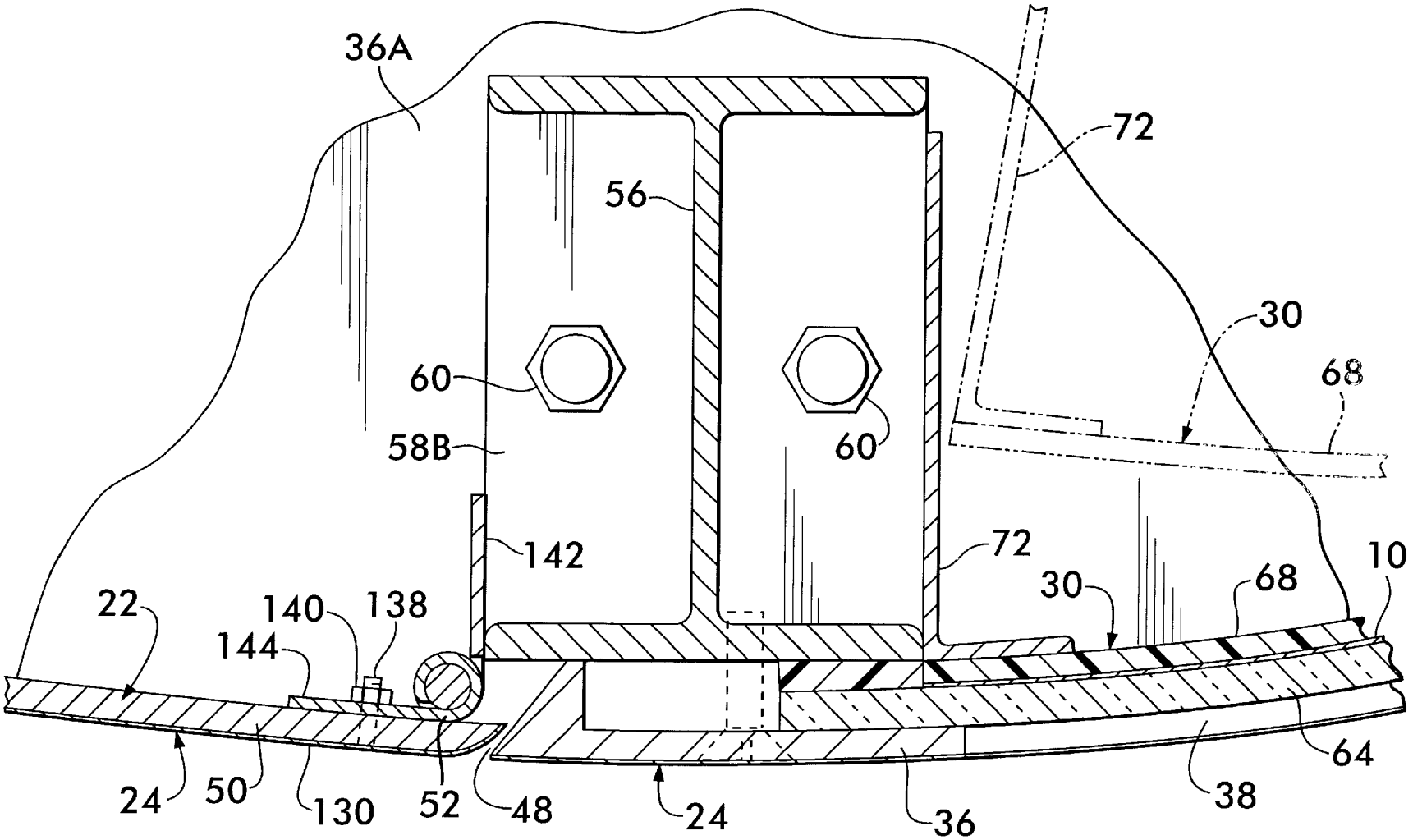
FIG. 5C is an enlarged sectional view taken along line 5C—5C of FIG. 2.
Figure 5D:
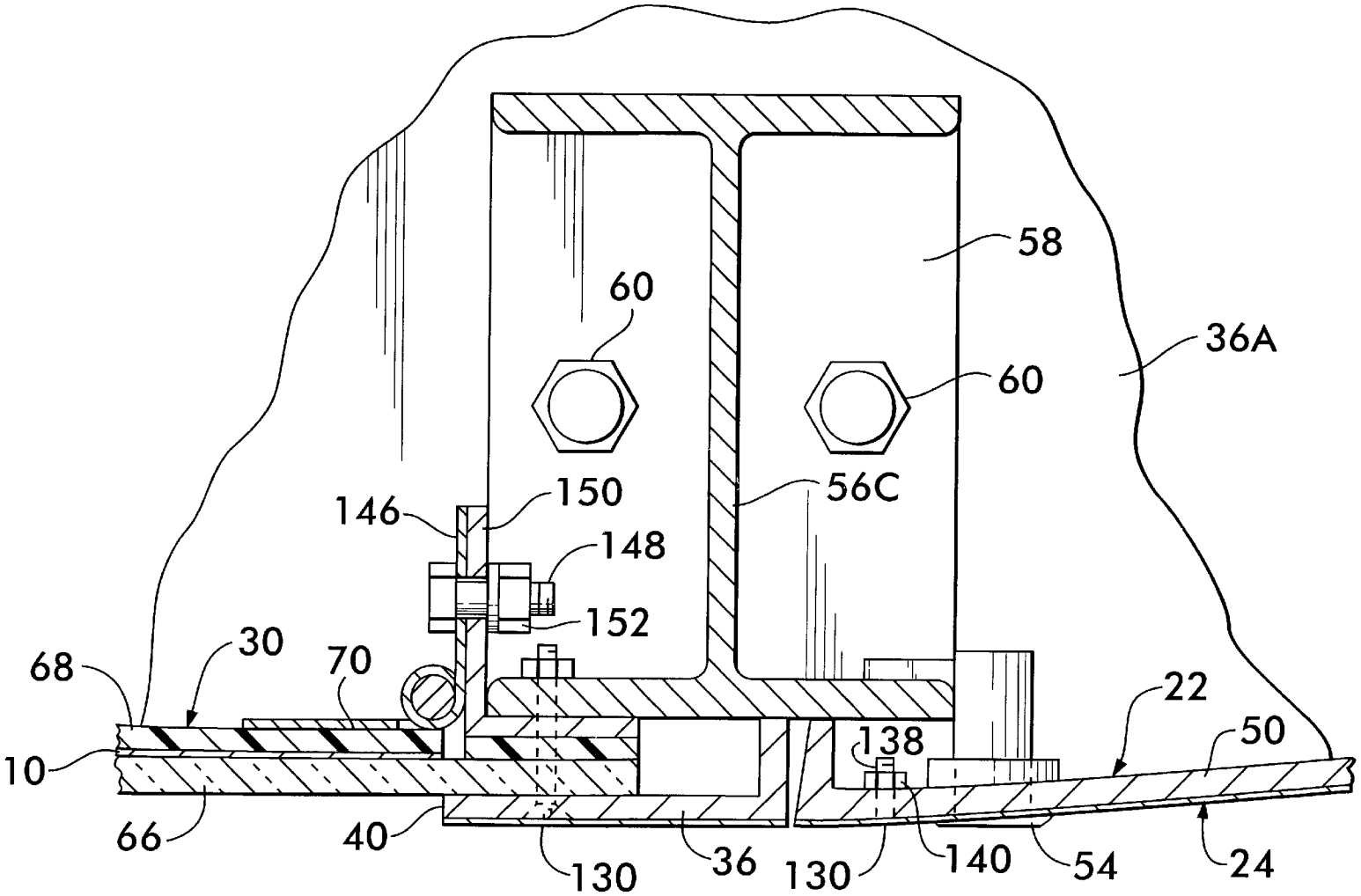
FIG. 5D is an enlarged sectional view taken along line 5D—5D of FIG. 2.

As mentioned earlier each window 38 and 40 is closed off by an arcuate outer transparent panel. In particular, the window 38 is closed off by arcuate outer panel 64 (FIG. 5C), while window 40 is closed off by arcuate outer panel 66 (FIG. 5D). The radius of curvature of each of the panels 64 and 66 is virtually the same as that of the shell 36 so that when the panels are mounted therein they are approximately flush with the shell (in actuality they are recessed very slightly as best seen in FIGS. 5C, 5D and 7). In accordance with one preferred embodiment of this invention each of the arcuate outer panels 58 and 60 is formed of LEXAN®, although other strong, scratch-resistant, transparent materials may be used.

As also mentioned earlier each sheet of advertising copy 10 is arranged to be held against the inner surface of the outer panel of the window in which that sheet of advertising copy is mounted by the advertising copy holding sub-system 30. The details of that subsystem will now be described with reference to FIGS. 5A–5D and 7. As can be seen therein the sub-system 30 basically comprises a flexible planar backer or diffuser sheet 68, a hinge 70 and a flanged handle 72. The diffuser 68 is formed of a thin sheet of a strong, yet somewhat resilient material, e.g., LEXAN®. The natural shape of the diffuser sheet 68 is planar, but it can flex or bend into an arc when a force is applied to it. However, the natural bias of the material will tend to resist the bending.

In accordance with one preferred aspect of this invention the diffuser sheet 68 is preferably a white or other neutral colored translucent material to enable light to pass evenly therethrough and be uncolored by the light. The white or neutral translucency of the material has the effect of evenly diffusing the light passing through it. If desired, the diffuser sheets can be formed of a colored translucent material or may be a transparent material, which is either uncolored or colored. In any case, each diffuser sheet is of the same shape as the window in which it will be located (in the disclosed embodiment 20 each is of a rectangular shape) and is approximately the same height as the window, but is ever-so slightly larger in width, e.g., 0.125 inch (3.1 8 mm), for reasons to be described later.

The hinge 70 for mounting the diffuser sheet in the shell is an elongated "piano" type hinge that is oriented vertically and has one portion fixedly secured, e.g,. welded, to an associated I-beam, e.g., I-beam 56C at the edge of the window 40. The other portion of the hinge 70 is fixedly secured by any suitable means, not shown, to one marginal vertical edge of the diffuser sheet 68, as shown in FIG. 5D. Thus, the diffuser sheet 68 can be swung or pivoted away from the inner surface of the outer panel 66 to provide access to the inner surface of the outer panel to place the advertising copy sheet 10 thereon. The flanged handle 72 is an elongated member fixedly secured by any suitable means (not shown) to the opposite edge of the diffuser sheet to enable a worker to grasp it to pivot the diffuser sheet away from the outer panel.

The mounting of a sheet of advertising copy 10 in either window is accomplished as follows. The handle 72 of the copy holding sub-system 30 is grasped by a worker and pulled inward, i.e., toward the center of the kiosk. This action causes the diffuser sheet 68 to pivot out of engagement with the associated arcuate outer panel. (See FIG. 5C where the diffuser sheet is shown pivoted partially away from the outer panel by the phantom lines). A sheet of advertising copy 10 can then be placed against the inner surface of the outer panel. The handle 72 of the diffuser sheet 68 can then be grasped and manipulated so that the diffuser sheet is forced to flex and "roll" like a wave into engagement with the back surface of the advertising copy sheet 10 starting with the edge closest to the hinge 70. Continued manipulation and pivoting of the diffuser sheet 68 causes it to continue to "roll" across the back surface of the advertising copy sheet 10 until it reaches the far edge of that panel (i.e., the edge furthest from the hinge).

As should be appreciated by those skilled in the art the "rolling" action of the diffuser sheet 68 ensures that the outer surface of the diffuser sheet makes intimate engagement with the inner surface of the advertising copy sheet 10 and that the outer surface of the advertising copy sheet 10 makes intimate engagement with the inner surface of the outer panel (64 or 66 as the case may be), thereby preventing any buckling or creasing of the interposed advertising copy sheet 10, while also forcing any air out the far marginal edge so that there will be no trapped air bubbles. This feature is of considerable importance insofar as aesthetics and evenness of illumination of the advertising copy is concerned.

Since the diffuser sheet 68 is ever-so slightly wider than the window in which it is located, when it is pivoted/rolled into the window so that it reaches the far edge it will snap-fit snugly into the window and be held in place by the frictional engagement between the flanged handle 72 and the immediately adjacent I-beam, thereby preventing the advertising copy to move or drift out of position. When it is desired to replace the advertising copy in either window, all that is required is to pull outward on the handle 72 to overcome the frictional engagement between it and the immediately adjacent I-beam, whereupon the diffuser sheet can be pivoted inward (i.e., away from the advertising copy sheet 10) to enable the copy to be removed.

The illumination of the advertising copy sheet is achieved by the illumination sub-system 26. In particular, that subsystem is arranged to pass light through the advertising copy to trans-illuminate the copy from within the interior of the kiosk. The illumination sub-system 26 basically comprises plural, e.g., 16, elongated electric lamps, e.g., high-output, fluorescent tubes 74, and plural mounting brackets 76. Each of the tubes in the exemplary embodiment is 85 watts so that the illumination sub-system delivers approximately 40,000 lumens per advertising copy sheet, so that each sheet appears to glow when viewed by passers-by. As best seen in FIGS. 2–4 the fluorescent tubes 74 are mounted between pairs electrical sockets 78 on the brackets 76 so that they extend vertically adjacent respective windows 38 and 40. Moreover, the fluorescent tubes are approximately equidistantly spaced from each other and from the inner surface of the diffusers 68 in the interest of evenness of lighting of the advertising copy.

Figure 8:
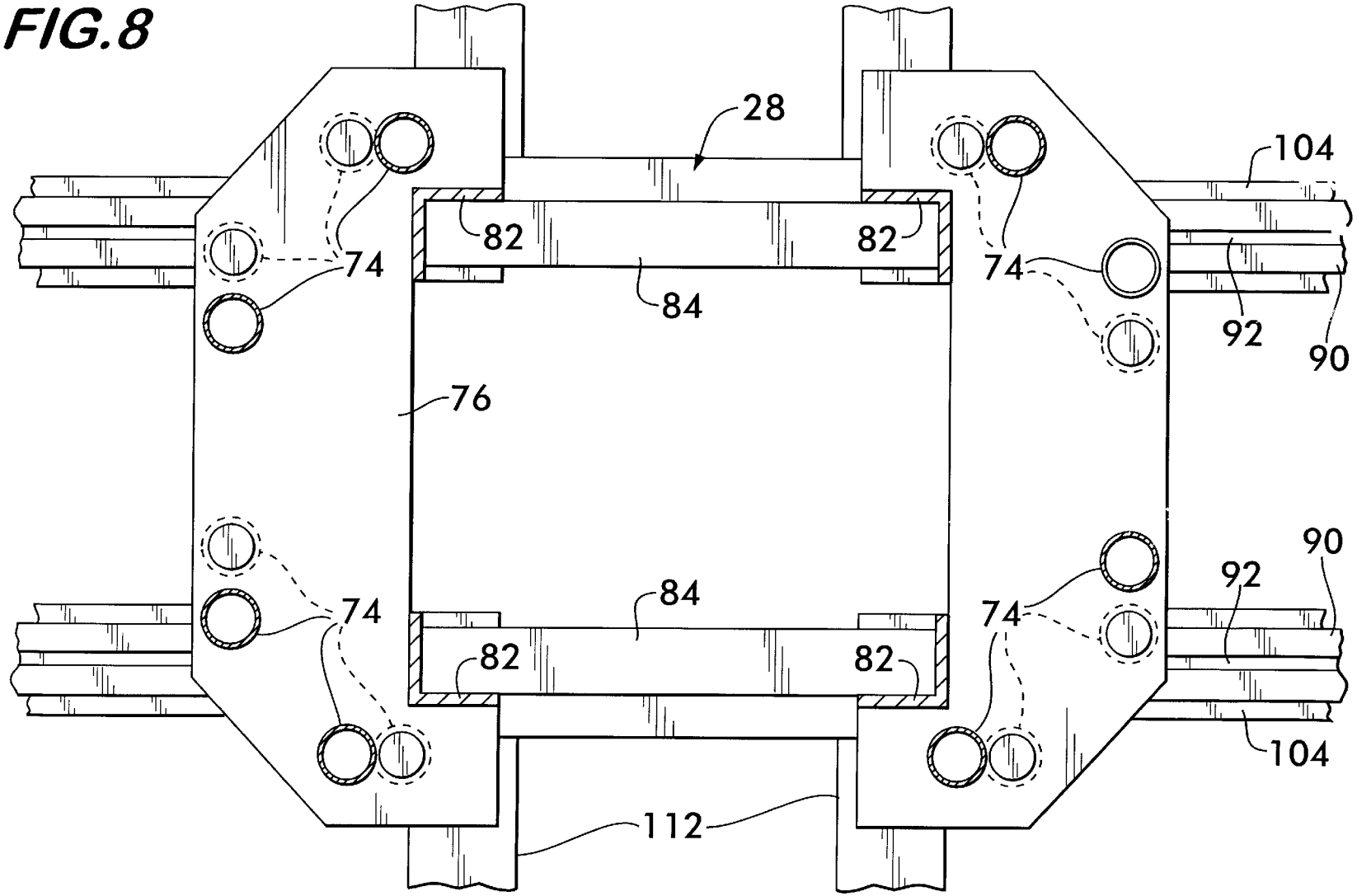
FIG. 8 is an enlarged sectional view taken along line 8—8 of FIG. 2.

Since the windows 38 and 40 are so tall in the exemplary kiosk 20 two tiers of the fluorescent tubes 74 are provided for the illumination sub-system of this particular embodiment, one tier on top of the other to extend the full height of the windows 38 and 40. As best seen in FIG. 8, the fluorescent tubes 74 in one tier are offset slightly from the tubes in the other tier in order to facilitate access to the sockets 78 in which they are mounted. Moreover, the two tiers of tubes 74 overlap slightly (e.g., by approximately two inches) at the center point to eliminate and dark spot or shadow at that point.

The brackets 76 for mounting the fluorescent tubes 74 are each flanged members which are mounted on a frame-like structure forming the heretofore identified illumination support frame sub-system 28. The sub-system 28 basically comprises a ladder-like frame assembly which is movably mounted within the interior of the shell 36. In its normal operative position the frame assembly is located in a neutral or centered position within the kiosk so that the light produced by the fluorescent tubes 74 mounted thereon will evenly illuminate the advertising copy of both of the windows 38 and 40. When any servicing of the interior of the kiosk is required or desirable, the frame assembly can be moved from its neutral position toward either of the windows. For example, the frame assembly 80 can be moved from its neutral position to a position close to the window 38. This action will provide enough room on the opposite side of the frame assembly to enable a worker to service any of the fluorescent lamps 74 on the other side (i.e., the lamps for illuminating the advertising copy sheet 10 in the window 40). Such action will also provide sufficient room for the worker to mount or dismount the advertising copy sheet 10 in the window 40. The frame assembly can be moved in the opposite direction as well, e.g., to a position close to the window 40 to provide enough room on the opposite side of it to enable a worker to service any of the lamps for illuminating the advertising copy sheet 10 in the window 38 or for enabling the worker to mount or dismount that advertising copy sheet 10 in window 38. Thus, the servicing of the components within the interior of the kiosk can be accomplished from entirely within the kiosk, thereby protecting the worker from inclement weather conditions which may exist outside the kiosk. After servicing of the kiosk has been completed the frame assembly 80 can then be moved back to its neutral position centered within the shell to effect the even lighting of both of the windows.

As best seen in FIGS. 2–6 and 8, the frame assembly basically comprises a pair of ladder-like members. Each of these members are made up of a pair of side posts 80 and plural horizontally disposed rungs 82 mounted between the posts. The brackets 76 for mounting the fluorescent lamps 74 are secured to the side posts 80 of the frame assembly via plural bolts 84. By virtue of the fact that the frame assembly is in the form of two ladders, a worker can climb up the assembly on the ladder rungs to reach any interior elevated portion of the kiosk, e.g., to service the fluorescent tubes 74 on the upper tier.

The means for movably mounting the lamp-supporting frame assembly within the kiosk 20 basically comprises a bottom platform 86 (FIG. 6) mounted on a pair of horizontally disposed channel-like rails 90 to be slid therealong. A layer 88 of TEFLON® is disposed under the platform to facilitate its sliding on the rails 90. The mounting of the frame assembly on the platform 86 is accomplished by welding the bottom of each of the side posts 80 of the frame assembly to the top surface of the platform 86 adjacent its respective corners.

As best seen in FIGS. 5A, 5B and 6 each of the rails 90 includes a longitudinally extending slot 92 in its top surface. A hole 86A (FIG. 6) is provided in each corner of the platform 86. Plural bolts 94, each having a shank 96, are used to releasably secure the platform 86 on the rails 90 to immobilize it when tightened and to free it for sliding when loosened. To that end the shank 96 of each bolt 94 extends through a respective hole 86A in a respective corner of the platform 86 and through the slot 92 in the associated channel-like rail 90. The end of the shank 96 is threaded and a nut 98 is mounted thereon. The head of the bolt 94 is in the form of a lever 100 projecting at an acute angle to the bolt's head 102 to be grasped by a worker to tighten or loosen the bolt. In particular, by twisting the lever 100 of each bolt in the clockwise direction, each bolt is tightened to tightly clamp the platform 86 to the associate rail 90. This action prevents the platform from sliding on the rails 90. When it is desired to enable the platform 86 to be slid on the rails 90, e.g., to locate the frame assembly 80 at any position along the rails (such as described above), all that is necessary is to twist the lever 100 of each bolt in the counter-clockwise direction to release the platform 86 from tight engagement with the rails 90, whereupon the platform 86 with the frame assembly and lamps mounted thereon can be slid to any position along the rails 90.

In accordance with the preferred embodiment of the kiosk 20 shown herein the rails 90 are themselves mounted and supported on respective base I-beams 104. That mounting accomplished by means of a pair of bolts 106 extending through holes in the bottom wall of the channel-like rails 90 and through aligned holes in the upper flange 108 of an associated base I-beam 104. A nut 110 is screwed onto each bolt 106. As best seen in FIGS. 3B, 4B, 5A, 5B, and 6 a pair of cross I-beams 112 are welded to the base I-beams 104 to provide additional support for the kiosk.

In order to facilitate movement or sliding of the frame assembly within the kiosk, the top of the frame assembly is slidingly supported withing a channel to be described hereinafter. This features keeps the tall frame assembly from tilting or skewing when the platform 86 is slid along the rails 90. To that end, and as best seen in FIGS. 4A and 9, the top of the frame assembly includes a horizontal top plate 114 which is welded to the upper ends of the ladders' side posts 80. An elongated plate 116 is welded onto the top surface of the top plate 114. A pair of elongated flanged members 118 and 120 are mounted horizontally within the upper portion of the shell 36 and extend diametrically thereacross. The flanged members 118 and 120 define a channel 122 between them in which the elongated plate 116 is disposed, with some slight space on each side, as shown clearly in FIG. 9. Thus, when the platform 86 with the frame assembly thereon is slid along the rails 90 the plate 116 will be guided within the channel 122 to prevent any tilting or skewing of the frame assembly.

Referring now to FIGS. 1–4 and 10 the details of the skin sub-system 24 will now be described. That system as mentioned earlier is arranged to be mounted on the exterior of the housing 22 (i.e., on the shell 36) to provide a smooth, unblemished, damage-resistant exterior surface. To that end the skin sub-system basically comprises plural thin, e.g., 0.0625 inch (1.59 mm), sheets 130 of any suitable attractive and tough material. In the preferred embodiment disclosed herein that material comprises stainless steel which is unpainted. Each thin sheet 130 is arranged to be wrapped or bent about a respective portion of the shell 36 and secured thereto to hold the sheet on the shell. The securement is preferably releasable, as will be described later, so that any portion of the skin of the kiosk can be replaced, if necessary. Each sheet of skin is cut to the profile of the shell portion to be covered by it to produce a skin section for use on that shell portion. As best seen in FIG. 10, each skin section 130 includes an outer surface 132, which may be polished or otherwise treated to provide a desired appearance, e.g., brushed, matte, etc., and an inner surface 134. A plurality of threaded studs 136 (FIGS. 7 and 10) are fixedly secured at numerous equally spaced positions across the skin section 130. In accordance with one preferred aspect of this invention the studs are secured by capacitive discharge welding to the inner surface 134 of each skin section 130 so that there will be no discoloration, surface irregularity or other blemish on the outer surface 134 where the stud is secured which would detract from the smooth uncluttered appearance of the skin, e.g., the stainless steel. Each stud 136 includes a threaded free end 138.

As best seen in FIGS. 5D and 7 the studs 136 are arranged to be extended through aligned openings or apertures 138 in the shell 36 to secure the associated skin section 130 to the shell portion to be covered. Nuts 140 are provided to hold the threaded ends 138 of the studs 136 of each skin section onto the inner surface of the shell portion to which the skin section is mounted.

The hinge 52 for mounting the door 50 within the doorway 48 is an elongated "piano" type hinge having one portion 142 secured, e.g., welded onto the I-beam 56B as best seen in FIG. 5C. The other portion 144 of that hinge is secured to the door 50 by means of plural threaded studs 136 forming a portion of the skin sub-system 24. Each stud 136 is in turn held in place by an associated nut 140.

As mentioned earlier, the hinge 70 for mounting the diffuser sheet 68 within its associated window is also an elongated "piano" type hinge having one portion 146 (FIG. 5D) secured via plural bolts 148 to a flanged member 150 fixedly secured along the length of the I-beam immediately adjacent that hinge (e.g., I-beam 56C for window 40 shown in FIG. 5D). A respective nut 152 is mounted onto each bolt 148. The flanged member 150 is welded to the I-beam.

The details of the air ventilation sub-system 32 will now be considered with reference to FIGS. 1–4. As can be seen therein the lower portion of the kiosk 20 includes a truncated conically shaped base member or skirt 160 formed of two semi-circular sections 160A and 160B. The sections can be formed of any suitable material, e.g., fiberglass, metal, etc. and are hollow members which when assembled around the bottom of the shell 36 form a skirt. Each of the sections 160A and 160B of the skirt is approximately 13 inches (0.33 meters) high and includes a vertical wall portion 162 in which are located a plurality of equidistantly spaced air-inlets 164. When the skirts sections are mounted together on the shell the interior of the skirt is in fluid communication with the interior of the kiosk (see FIGS. 3B and 4B). Thus, air is enabled to flow into the air inlets 164 through the hollow interior of the skirt 160 and up into the interior of the kiosk via the bottom of the shell 36.

As mentioned earlier the header 42 includes a cylindrical sidewall 42A and a top wall 42B (which are preferably formed as an integral unit). As best seen in FIGS. 2, 3A and 4A the header 42 is mounted on the top edge of the shell 36 via plural brackets 166 on the lower lip or edge 168 of the header sidewall 42A. The inner diameter of the header 42 is slightly larger than the outside diameter of the shell 36 even with the skin panels 130 thereon, so that the header's lower lip or edge 168 overhangs the top of the shell to form an annular air-vent 170 therebetween. The air-vent 170 forms a portion of the ventilation sub-system 32. The air-vent 170 is in fluid communication with the outside of the kiosk and with the inside of the shell 36. Thus, air can flow into the bottom of the kiosk 20 via the air inlets 164 in the skirt. From there the air can flow up through the interior of the shell 36 and out of the air-vent 170 as a result of convection currents produced by the intrinsic heat generated by the lamps 74 or by sunlight hitting the outside of the kiosk. Thus, the ventilation sub-system enables air to be brought into the kiosk from the bottom of the kiosk and vented through the top of the kiosk resulting in continuous air exchange flow through the kiosk which has the effect of keeping the interior components, e.g., the lamps, of the kiosk cool to prevent overheating, while also preventing the build up of condensation or moisture within the kiosk which could result in fogging of the advertising copy. These actions tends to preserve the integrity of the interior components of the kiosk and the advertising copy sheets. Moreover, since there will be no condensation or fogging within the kiosk, the image of the advertising copy as seen through the clear outer panels will be clear and unencumbered.

It should be pointed out at this juncture that a kiosk constructed in accordance with this invention need not have two windows for holding the advertising copy. In this regard it is contemplated that the kiosk may have only one window (which may extend greater than 180 degrees about the periphery of the kiosk), or can have more than two windows. In the latter case the three or more windows can be disposed about the periphery of the kiosk and/or stacked in tiers at predetermined positions on the kiosk.

Without further elaboration the foregoing will so fully illustrate our invention that others may, by applying current or future knowledge, adopt the same for use under various conditions of service.

We claim:

1. A kiosk for supporting at least one sheet of advertising copy, the sheet of advertising copy being formed of a translucent material and bearing graphics and/or text thereon, said kiosk being arranged to be mounted on a surface and comprising a hollow shell having at least one window located therein, a source of illumination located within said shell and adjacent said window, and a flexible backer sheet, said window being covered by a transparent outer panel secured to said shell, said outer panel having an inner surface behind which the sheet of advertising copy is arranged to be mounted, said flexible backer sheet being connected to said shell by a hinge and being disposed opposite to said window, said flexible backer sheet being adapted to pivot away from said outer panel via said hinge to enable the sheet of advertising copy to be placed between said flexible backer sheet and said inner surface of said outer panel and to pivot toward said outer panel via said hinge to flex into engagement with the sheet of advertising copy, whereupon the sheet of advertising copy is held tightly and evenly against said inner surface of said outer panel by said backer sheet, said source of illumination being arranged to provide light through said flexible backer sheet, the sheet of advertising copy and said outer panel to illuminate the sheet of advertising copy for visibility by persons outside of said kiosk.

2. The kiosk of claim 1 wherein said source of illumination comprises plural elongated lamps mounted on a support frame within said shell, whereupon said lamps are disposed vertically at equidistantly spaced behind said window to effect the even illumination of the advertising copy sheet.

3. The kiosk of claim 2 wherein said support frame includes rungs to enable a person to climb up on said frame.

4. The kiosk of claim 2 wherein said support frame is moveable within said shell to facilitate access to said lamps.

5. The kiosk of claim 1 wherein said shell includes a bottom portion and a top portion, at least one air-intake opening in said bottom portion of said shell and at least one air-outlet in said top portion of said shell to facilitate the flow of air through said shell.

6. The kiosk of claim 1 wherein said shell includes plural apertures therein, and wherein said kiosk additionally comprises an outer covering, said outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures.

7. The kiosk of claim 6 wherein said outer covering comprises stainless steel.

8. A kiosk for supporting at least one sheet of advertising copy, the sheet of advertising copy being formed of a translucent material and bearing graphics and/or text thereon, said kiosk being arranged to be mounted on a surface and comprising a hollow shell having at least one window located therein, a source of illumination located within said shell and adjacent said window, and a flexible backer sheet, said window being covered by a transparent outer panel secured to said shell, said outer panel having an inner surface behind which the sheet of advertising copy is arranged to be mounted, said flexible backer sheet being hingedly connected to said shell and disposed opposite to said window and adapted to flex into engagement with the sheet of advertising copy, whereupon said sheet of advertising copy is held tightly and evenly against said inner surface of said outer panel by said backer sheet, said source of illumination being arranged to provide light through said backer sheet, the advertising copy sheet and said outer panel, to illuminate the sheet of advertising copy for visibility by persons outside of said kiosk, said shell including plural apertures therein, said kiosk additionally comprising an outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures, said kiosk also including second connector elements for releasable securement to said first connector elements.

9. The kiosk of claim 8 wherein said first and second connector elements are threaded.

10. A kiosk for supporting at least one sheet of advertising copy, the sheet of advertising copy being formed of a translucent material and bearing graphics and/or text thereon, said kiosk being arranged to be mounted on a surface and comprising a hollow shell having at least one window located therein, a source of illumination located within said shell and adjacent said window, said window being covered by a transparent outer panel secured to said shell, said outer panel having an inner surface behind which the sheet of advertising copy is arranged to be disposed, said source of illumination comprising plural elongated lamps mounted on a support frame within said shell, whereupon said lamps are disposed vertically at equidistantly spaced behind said window to effect the even illumination of the advertising copy sheet for visibility by persons outside of said kiosk, said support frame being moveable within said shell to facilitate access to said lamps.

11. The kiosk of claim 10 wherein said support frame includes rungs to enable a person to climb up on said frame.

12. The kiosk of claim 10 additionally comprising a flexible backer sheet, said window being covered by a transparent outer panel secured to said shell, said outer panel having an inner surface behind which the sheet of advertising copy is arranged to be mounted, said flexible backer sheet being hingedly connected to said shell and disposed opposite to said window and adapted to flex into engagement with the sheet of advertising copy, whereupon said sheet of advertising copy is held tightly and evenly against said inner surface of said outer panel by said backer sheet.

13. The kiosk of claim 10 wherein said shell includes a bottom portion and a top portion, at least one air-intake opening in said bottom portion of said shell and at least one air-outlet in said top portion of said shell to facilitate the flow of air through said shell.

14. The kiosk of claim 10 wherein said shell includes plural apertures therein, and wherein said kiosk additionally comprises an outer covering, said outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures.

15. The kiosk of claim 14 wherein said kiosk also includes second connector elements for releasable securement to said first connector elements.

16. The kiosk of claim 15 wherein said first and second connector elements are threaded.

17. The kiosk of claim 14 wherein said outer covering comprises stainless steel.

18. A kiosk for supporting at least one sheet of advertising copy, the sheet of advertising copy being formed of a translucent material and bearing graphics and/or text thereon, said kiosk being arranged to be mounted on a surface and comprising a sealed housing including a hollow shell adapted to have a person enter the shell for maintenance of the kiosk whereupon the person is protected from the ambient conditions outside of the kiosk, said shell including a bottom portion, a top portion, at least one window located in said shell, said bottom portion of said shell comprising a skirt having plural, equidistantly spaced air-intake openings, said shell also including an air-outlet in said top portion of said shell extending about the periphery thereof to facilitate the flow of air through said shell, said kiosk also including a source of illumination located within said shell adjacent said window, said window being covered by a transparent outer panel secured to said shell, said outer panel having an inner surface behind which the sheet of advertising copy is arranged to be disposed, said source of illumination being arranged to effect the illumination of the advertising copy sheet for visibility by persons outside of said kiosk.

19. The kiosk of claim 18 wherein said source of illumination comprises plural elongated lamps mounted of a support frame within said shell, whereupon said lamps are disposed vertically at equidistantly spaced behind said window to effect the even illumination of the advertising copy sheet.

20. The kiosk of claim 19 wherein said support frame includes rungs to enable a person to climb up on said frame.

21. The kiosk of claim 19 wherein said support frame is moveable within said shell to facilitate access to said lamps.

22. The kiosk of claim 19 wherein said shell includes plural apertures therein, and wherein said kiosk additionally comprises an outer covering, said outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures.

23. The kiosk of claim 22 wherein said kiosk also includes second connector elements for releasable securement to said first connector elements.

24. The kiosk of claim 23 wherein said first and second connector elements are threaded.

25. The kiosk of claim 22 wherein said outer covering comprises stainless steel.

26. The kiosk of claim 18 additionally comprising a flexible backer sheet, said window being covered by a transparent outer panel secured to said shell, said outer panel having an inner surface behind which the sheet of advertising copy is arranged to be mounted, said flexible backer sheet being hingedly connected to said shell and disposed opposite to said window and adapted to flex into engagement with the sheet of advertising copy, whereupon said sheet of advertising copy is held tightly and evenly against said inner surface of said outer panel by said backer sheet.

27. A kiosk for supporting at least one sheet of advertising copy, the sheet of advertising copy being formed of a translucent material and bearing graphics and/or text thereon, said kiosk being arranged to be mounted on a surface and comprising a sealed housing including a hollow shell adapted to have a person enter the shell for maintenance of the kiosk whereupon the person is protected from the ambient conditions outside of the kiosk, an outer covering for said shell, a window and a source of illumination located within said shell adjacent said window, said window being covered by a transparent outer panel secured to said shell, said outer panel having an inner surface behind which the sheet of advertising copy is arranged to be disposed, said source of illumination being arranged to effect the illumination of the advertising copy sheet for visibility by persons outside of said kiosk, said shell also including plural apertures therein, said outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures, said kiosk also including second connector elements for releasable securement to said first connector elements.

28. The kiosk of claim 27 wherein said first and second connector elements are threaded.

29. The kiosk of claim 27 wherein said outer covering comprises stainless steel.

30. The kiosk of claim 29 wherein said first connector elements are secured to said covering sheet by electrocapacitive discharge bonding.

31. The kiosk of claims 27 wherein said source of illumination comprises plural elongated lamps mounted of a support frame within said shell, whereupon said lamps are disposed vertically at equidistantly spaced behind said window to effect the even illumination of the advertising copy sheet.

32. The kiosk of claim 31 wherein said support frame includes rungs to enable a person to climb up on said frame.

33. The kiosk of claim 31 wherein said support frame is moveable within said shell to facilitate access to said lamps.

34. The kiosk of claim 27 additionally comprising a flexible backer sheet, said window being covered by a transparent outer panel secured to said shell, said outer panel having an inner surface behind which the sheet of advertising copy is arranged to be mounted, said flexible backer sheet being hingedly connected to said shell and disposed opposite to said window and adapted to flex into engagement with the sheet of advertising copy, whereupon said sheet of advertising copy is held tightly and evenly against said inner surface of said outer panel by said backer sheet.

35. The kiosk of claim 27 wherein said shell includes a bottom portion and a top portion, at least one air-intake opening in said bottom portion of said shell and at least one air-outlet in said top portion of said shell to facilitate the flow of air through said shell.

36. A kiosk for supporting at least one sheet of advertising copy, the sheet of advertising copy being formed of a translucent material and bearing graphics and/or text thereon, said kiosk being arranged to be mounted on a surface and comprising a hollow shell having at least one window located therein, a source of illumination located within said shell and adjacent said window, said window being covered by a transparent outer panel secured to said shell, said outer panel having an inner surface behind which the sheet of advertising copy is arranged to be disposed, said source of illumination being mounted on a support frame within said shell, said support frame being movable within the shell to enable a person to enter into the shell to service the kiosk from within, said source of illumination being arranged to effect the even illumination of the advertising copy sheet for visibility by persons outside of said kiosk.

37. The kiosk of claim 36 wherein said support frame includes rungs to enable a person to climb up on said frame.

38. The kiosk of claim 36 additionally comprising a flexible backer sheet, said window being covered by a transparent outer panel secured to said shell, said outer panel having an inner surface behind which the sheet of advertising copy is arranged to be mounted, said flexible backer sheet being hingedly connected to said shell and disposed opposite to said window and adapted to flex into engagement with the sheet of advertising copy, whereupon said sheet of advertising copy is held tightly and evenly against said inner surface of said outer panel by said backer sheet.

39. The kiosk of claim 36 wherein said shell includes a bottom portion and a top portion, at least one air-intake opening in said bottom portion of said shell and at least one air-outlet in said top portion of said shell to facilitate the flow of air through said shell.

40. The kiosk of claim 36 wherein said shell includes plural apertures therein, and wherein said kiosk additionally comprises an outer covering, said outer covering comprising at least one flexible panel having an outer surface, an inner surface and plural first connector elements fixedly secured to said inner surface without any trace of the securement being visible from said outer surface, said flexible covering panel being mounted on said shell by extending said plural connector elements through said apertures.

41. The kiosk of claim 40 wherein said kiosk also includes second connector elements for releasable securement to said first connector elements.

42. The kiosk of claim 41 wherein said first and second connector elements are threaded.

43. The kiosk of claim 40 wherein said outer covering comprises stainless steel.

44. The kiosk of claim 36 wherein said kiosk includes at least one track coupled to said support frame and along which said support frame is arranged to move.

* * * * *

UNITED STATES PATENT AND TRADEMARK OFFICE

CERTIFICATE OF CORRECTION

PATENT NO. : 6,427,369 B1 
DATED : August 6, 2002
INVENTOR(S) : Dominic J. Durinzi Jr., Robert Goepel and Jozef Rzeznik It is certified that error appears in the above-identified patent and that said Letters Patent is hereby corrected as shown below:

Title page,
Item [57], ABSTRACT,
Line 3, insert -- a -- between "with" and "pair";

Column 1,
Line 49, delete "0,289,062" and replace with -- D289,062 --;

Column 3,
Line 12, add a -- . -- after the word "disposed";

Column 4,
Line 28, delete "a" and replace with -- an --;

Column 5,
Line 57, delete "a" and replace with -- an --;

Column 6,
Line 50, delete "lock" and replace with -- locks --;
Line 66, delete "FIGS." and replace with -- FIG. --;

Column 7,
Line 2, delete "FIGS." and replace with -- FIG. --;

Column 8,
Line 56, insert -- of -- before "electrical";

Column 9,
Line 4, delete "and" and replace with -- any --;

Column 10,
Line 32, delete "withing" and replace with -- within --;
Line 33, replace "features" with -- feature --;

UNITED STATES PATENT AND TRADEMARK OFFICE

CERTIFICATE OF CORRECTION

PATENT NO. : 6,427,369 B1 
DATED : August 6, 2002
INVENTOR(S) : Dominic J. Durinzi Jr., Robert Goepel and Jozef Rzeznik It is certified that error appears in the above-identified patent and that said Letters Patent is hereby corrected as shown below:

Column 11,
Line 46, replace “skirts” with -- skirt --;

Column 12,
Line 10, replace “tends” with -- tend --;

Column 15,
Line 50, replace “claims” with -- claim --.

Signed and Sealed this

Seventeenth Day of June, 2003

JAMES E. ROGAN
*Director of the United States Patent and Trademark Office*